United States Patent [19]

Bodkin

[11] 4,201,183

[45] May 6, 1980

[54] BOW HAVING A SELF HELD COCK POSITION

[76] Inventor: Lawrence E. Bodkin, 1833 Ryar Rd., Jacksonville, Fla. 32216

[21] Appl. No.: 903,937

[22] Filed: May 8, 1978

[51] Int. Cl.[2] ..... F41B 5/00

[52] U.S. Cl. ..... 124/24 R; 124/91; 124/90

[58] Field of Search ..... 124/23 R, 24 R, 41 A, 124/90, 86, 88; 273/102.1 R

[56] References Cited

U.S. PATENT DOCUMENTS

| | | | |
|---|---|---|---|
| 2,957,469 | 10/1960 | Wilkerson | 124/24 R |
| 2,957,470 | 10/1960 | Barna | 124/24 R |
| 3,258,000 | 6/1966 | Kolpacki | 124/23 R |
| 3,486,495 | 12/1969 | Allen | 124/24 R |
| 3,497,221 | 2/1970 | Green | 273/102.1 R |
| 3,513,820 | 5/1970 | Thompson | 124/23 R |
| 3,965,883 | 6/1976 | Meyer | 124/90 X |

*Primary Examiner*—William R. Browne

*Attorney, Agent, or Firm*—George H. Baldwin; Arthur G. Yeager

[57] ABSTRACT

A bow having a rigid handle section and a pair of resiliently and flexibly recurved limb sections, with limb tip nocks and bowstring.

The bow has self-holding, cock position of higher brace for the retention of potential energy. The bow is selectively releasable from such cock position to another position of lower brace for the delivery of such potential energy.

The limb may have a slot in the direction of string travel for the free passage of the bowstring therethrough.

The bowstring includes a bowstring length related to limb characteristic and where applicable also includes a design to provide such free and direct path by a bifurcation or a division of the string, spaced by an enlargement of the limb nocking sections for passage of the string portions on either side of the limbs, such space being maintained for a sufficient distance by a yoke means adjacent to a central arrow nocking section wherein the string portions are undivided.

25 Claims, 4 Drawing Figures

BOW HAVING A SELF HELD COCK POSITION

BACKGROUND OF THE INVENTION

1. Field of the Invention

This invention relates to archery bows designed for the projection of arrows or like missles and providing special characteristics such as greater projecting force near the end of bowstring travel. More importantly the invention provides a bow having a pre-drawn, self-holding cock capability for the retention of potential energy and its conveniently manageable release.

2. DESCRIPTION OF THE PRIOR ART

Many bow designs have been made to effect improvement in cast and in convenience, to produce a bow that projects an arrow or like missle with greater power and which may be efficiently handled.

The comparatively recent advent of the compound bow with its complex stringing over an eccentric wheel and pulley system has demonstrated the advantages of a reduced holding requirement at full draw and increased final thrust in facilitating greater accuracy and penetrating power. U.S. Pat. No. 3,486,495 to H. W. Allen illustrates this type of prior art bow.

The ancient, but still highly valued, crossbow is recognized for its capability of extending the power of the bow by permitting the storage and nearly effortless release of force far greater than the strongest arm could generate in a simple hand held and drawn bow. These prior art systems are relatively elaborate mechanisms and as such are more expensive to manufacture than the more common bow designs of comparable quality. They are also heavier and subject to various problems of maintenance generally associated with devices having an appreciable multiplicity of moving and interacting parts.

Bows having longitudinally slotted recurved limbs have been introduced that apply the principle of a free string bracing to the problem of improving cast in a simple manner, but not to the problem of energy storage. A bow of this type is shown by U.S. Pat. No. 2,957,470 to A. J. Barna.

No known prior system, either alone or in any appropriate combination, is believed to anticipate or teach the herein disclosed invention, nor do prior systems function in the manner herein disclosed to solve the heretofore problems of such prior systems.

SUMMARY OF THE INVENTION

In accord with this invention a bow includes a rigid handle portion joining two resiliently flexible limbs, each limb when unstressed extending from such handle portion in a rearwardly inclined direction for a respective first length portion adjacent the handle portion and curving gradually from such direction into a forwardly inclined resiliently bendable free end portion terminating in a limb nock. A section of each limb between its free end portion and the handle portion is resilient and recurved. A bowstring connected between the nocks of the limbs has a length equal to the distance between the nocks when a portion in each of the sections of the limbs is substantially straight so that the bow is maintained in a self-holding cock position of high brace. The limbs and bowstring are selectively releasable to permit travel of the limbs and bowstring to a low brace position.

Other aspects of the invention are seen to relate to the fact that the limbs should be of substantially matching operating characteristics, and generally equal in length, and in the preferred embodiment the limbs are bifurcated adjacently below the nocks to substantially freely pass the bowstring therethrough during its normal path of travel between the low and high brace positions, and the handle portion is also bifurcated adjacent each limb to substantially freely pass the bowstring therethrough into its low brace position.

The limbs are solely recurved in the unstrung condition of the bow, in the strung condition thereof in a low position of brace and in positions between low brace and the self-holding or cock brace. The bowstring length is determined by the distance between the nocks when the limbs are drawn to a position in which a small amount of curve is produced in each limb, being minimal at this point. The bowstring thus determined is drawable from the low to a high position of brace in which the bow is maintained within its constrainment in a self-holding cock position by counteractive forces which should include no more than the small amount of curve in each limb, so as to be made selectively releasable by an increased draw and release or a forward force applied to bowstring or limbs.

In another embodiment of the bow in accord with the invention the bowstring includes means for substantially avoiding contact of its connective span between the nocks with each of the limbs, rather than the limbs being bifurcated. In such a bow, the means is seen to include a pair of longitudinal divisions of its connective span spaced to pass on either side of respective limbs during the normal travel of the bowstring. Such means may include a substantial enlargement of the nock connective loops to permit passage of the limbs therethrough spread apart by an enlarged nocking section and appropriate spacer yokes.

Additional aspects relate to the rigid handle section including opposite portions inclined toward each other and having an included angle of less than 180°. The position of higher brace preferably has a height slightly less than the length of full draw of the bow so that a small amount of additional draw can release the bow from its self-cock position. The draw weight is also generally made greater than weights commonly accepted as being drawable in hand held bows so that means for foot assistance in drawing is provided to the bow.

A general object of this invention is to make a bow system that retains a primitive level of simplicity for reduced cost, weight and maintenance, yet provides sophisticated characteristics in the quality of its performance and handling.

A principle object is to provide an archer's bow that may be made to store energy in a cock position that may be predrawn or achieved prior to nocking of the arrow, that is both self-holding and releaseable without benefit of any conventional catch and trigger mechanisms.

A particular object is to provide for the decisive release of the stored energy in the cock position with simultaneous and cooperative limb action.

A further object is to provide such release, after nocking of the arrow, by a simple completion of the draw, followed by a convenient and customary manner of bowstring release.

An additional object is to impart an increased final string thrust to the arrow to improve cast.

BRIEF DESCRIPTION OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing, in which:

DESCRIPTION OF THE PREFERRED EMBODIMENTS

Figure 1:
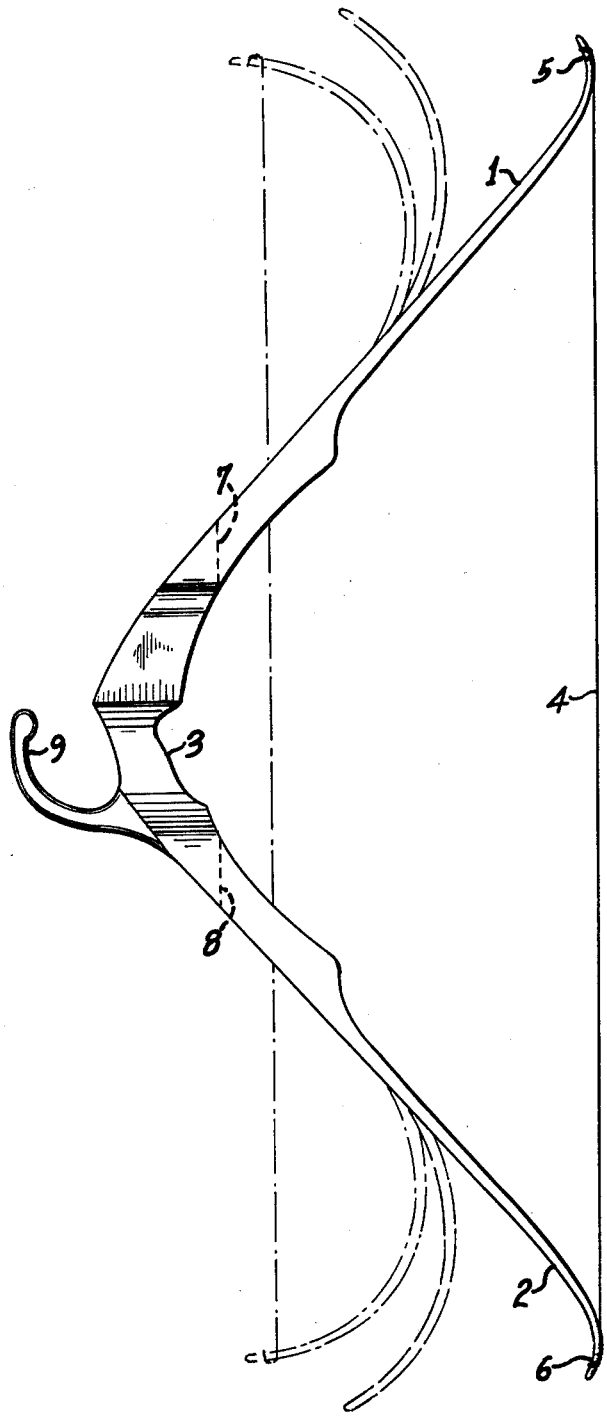
FIG. 1 is a side elevational view of a bow in self-holding cock position in accord with this invention.
Figure 2:
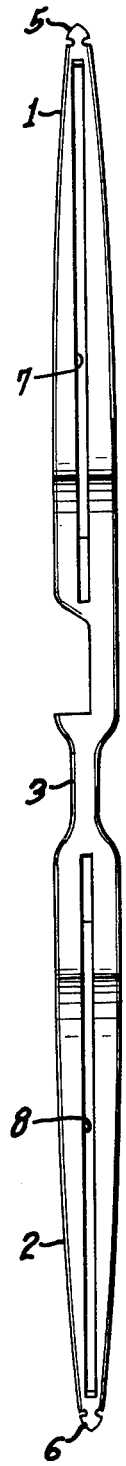
FIG. 2 is a right side elevational or belly view of the bow of FIG. 1 in the unstrung condition.

In accord with this invention, the bow shown in FIGS. 1 and 2 comprises an upper resiliently flexibly recurved limb section 1 of substantially conventional taper, and a lower flexibly recurved limb section 2 of substantially matching operating characteristics, as shown in unstrung position by broken dash lines, a centrally located, substantially rigid handle-riser section 3 determining the primary curve of the bow, a conventional, stretch resistant, double loop bowstring 4, of predetermined length, secured in conventional bowlimb nocks 5 and 6 and passing through longitudinal bowstring slots 7 and 8 of upper and lower limbs 1 and 2 respectively to permit a substantially uninterrupted or direct passage of the connective span of bowstring 4 between bowlimb nocks 5 and 6, and foot stirrup 9 which may be employed to assist in the drawing of a particularly heavy or powerful bow to the cock position of self-holding higher brace. Dividing slots 7 and 8 of limbs 1 and 2 are extended into handle-riser section 3 as needed to provide free movement of the string 4 throughout its travel.

The stability of the self-holding cock position, as shown in solid lines of FIG. 1, may be disturbed by an external triggering force that reverses the bias of counteractive forces present in the limbs at the higher brace position. They may consequently be permitted to assume their most forward brace position, as shown in broken dot-dash lines of FIG. 1, with a delivery of their potential energy to the bowstring 4, and to an arrow or any other projectile adapted to be driven by it. This externally supplied unstabilizing influence can be a forward urging applied directly to either or both of the limb tips, or to the bowstring, but is more advantageous if it is elastically and inertially obtained by drawing the bow slightly further and releasing the bowstring in the usual manner. The instability or sensitivity of the self-holding cock brace position is controllable with the extent of overbracing and is thus adjustable with string length. The simple twisting or untwisting of the bowstring when temporarily detached at one end is a generally acceptable and convenient means of accomplishing a fine adjustment of string length which does not complicate the structure.

In drawing the bow from the most forward brace position, as depicted by the broken dot-dash lines of FIG. 1, the tips are first pulled forcibly in a reflex direction then reversed to generally parallel the string. The angle of primary effort is then directed progressively from a straightening of the heavier, less flexible sections of limbs 1 and 2 adjacent to the handle-riser section 3 to the straightening of the less heavy, more flexible sections of limbs 1 and 2 adjacent to the limb nocks 5 and 6. The draw weight increases rapidly then decreases rapidly as the draw progresses, and as in the compound bow serves to supply increased final thrust to the arrow for improved cast.

With a condition of sufficiently high brace, and in accord with this invention, the counteractive urging of a beginning curve is employed to prevent recurve recovery and to cause the limbs to achieve a self-holding condition of adjustably greater or lesser stability as depicted in the solid line representation of FIG. 1. This property may be used to produce especially powerful but simple bows that possess many of the valuable characteristics of the crossbow. Such bows may be brought to the predrawn or cock brace position with the assistance of the feet and the projecting stirrup 9, then after nocking of the arrow, have their potential energy conveniently released in the aforementioned manner. The bow may also be cocked by placing the foot on the string and grasping the handle, but the limbs may suffer from ground contact in this instance.

Figure 3:
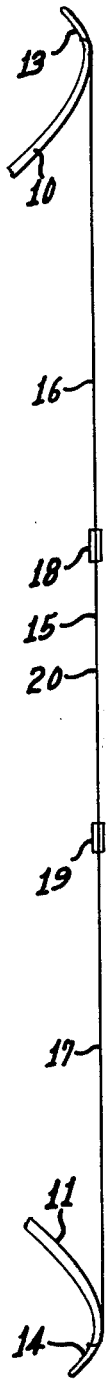
FIG. 3 is a partial side elevational view of the limb ends and bowstring assembly of another embodiment of the bow in self-holding cock position in accord with this invention.

A side view depicting the ends of an upper limb 10 and a lower limb 11 of another embodiment in accord with this invention is shown in FIG. 3. Enlarged limb nocks 13 and 14 secure bowstring 15 and space the nock ends of its enlarged upper and lower loops 16 and 17, while triangular yoke members or devices 18 and 19 serve to space the loop ends on either side of the undivided central arrow nocking area 20 of the bowstring 15. The enlarged upper and lower loops 16 and 17 are spaced to clear upper and lower limbs 10 and 11 respectively, passing on either side thereof.

Figure 4:
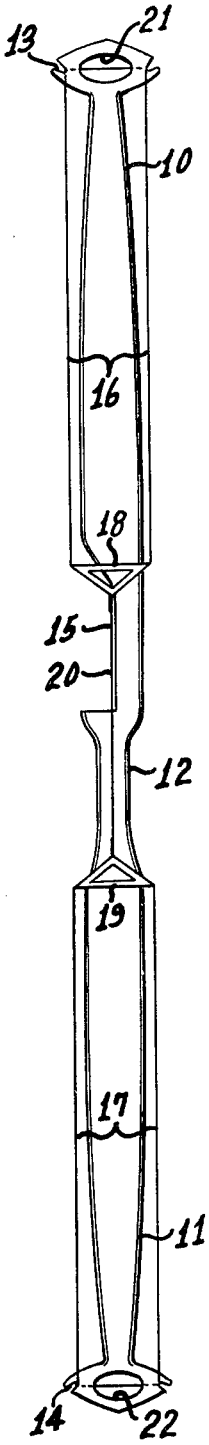
FIG. 4 is a right side elevational or belly view of the bow of FIG. 3.

FIG. 4 depicts a belly view of the complete embodiment including handle-riser 12. This alternative embodiment achieving a direct and uninterrupted bowstring connection employs unslotted limbs which are conventional except for the matter of the exclusion of flexible curve and the notably enlarged nock ends, which function conventionally in the securing of the bowstring. The triangular yoke members 18 and 19, should be made as strong but as light as possible and should be secured by servings, or by other equally effective means. While the use of members 18 and 19 etc., is considered to be comparatively unwieldy and subject to inertial difficulties induced by the additionally required material, some advantages may be obtained in this embodiment such as eliminating the need for strength compensation in the limbs which is caused by slotting. Weight should ordinarily be reduced where possible, as in the example of the enlarged nock ends which have been centrally relieved by openings 21 and 22.

When a conventional archer's bow, of the type incorporating a long working recurve in its limb sections or structure, is braced for its normal brace height or fistmele, the brace position is substantially near the position required for stringing and represents the undrawn or most forward rest or low position of the braced bow. The bowstring passes directly between the limb tip nocking points except for its small length of contact with the rearward surfaces of the limbs adjacent to the nocks. Any pressure urging the limbs forward of this low position results in a resistive increase in the length of this contact. Any substantial limb movement forward of any such given brace position to a position of lesser brace height is normally associated with an increase in bow string length. A simple bow, lacking recurve, cannot be so provided with such an alternative, but a bow having a substantially recurved limb structure may be modified to provide a more forward limb position of lower brace, without an increase in its bowstring length and accordingly may be adapted to provide valuable bow characteristics not previously known in the prior art.

If the bow is provided with a means for achieving a substantially direct or free string condition—a condition in which the bowstring is relatively free to pass directly between limb tip nocks and to greatly reduce or substantially eliminate the aforementioned small length of contact with limb surfaces - the pattern of constraining effort as applied to the limbs by the bowstring is altered and once the stringing is accomplished, and the tension taken up by the bowstring, the limbs may assume a far more forward position of lower brace that is sustained by the same bowstring length. In achieving this position, the recurved sectors of the limbs which were greatly straightened in the initial stringing or bending to the normal brace, regain and then exceed their unbraced recurvature under a reflex tension that the bowstring provides in the most forward or low position.

It should be noted that a reflex direction of limb is away from the archer and one which is normally opposed by the bowstring.

One notably employable bow characteristic resulting from this application of the free string principle to the recurve bow limbs is the greater initial draw force requirement which, in return, also means an increase in the force delivered to the projected arrow at or near the time it leaves the string. The effect resembles that of the compound bow. Oppositional influences cause the draw to increase rapidly then decrease as the drawing of the bow progresses from the new forward position toward the normal brace position where holding may be accomplished with reduced effort.

Another unusual characteristic found in accord with this invention and attainable in the solely recurved bow with free string properties is obtained in a condition of relatively high brace. If a sufficiently short bowstring is employed in bracing, the angle and degree of constraining effort applied to the limb tips becomes such that the restoration of recurve which causes the more forward positioning of lower brace may be fully opposed. A forward motion of the limbs, with recovery of recurve, must always overcome a contrary urging in the limbs that increases with their degree of constrainment. When this urging is made excessive the forward position of lower brace will not be assumed when the stringing effort is relaxed. The limbs will tend to hold at or near the stringing position of higher brace, which may be the normal brace of an unmodified bow, with an adjustable extent of self-holding stability. If brace height is just above the position required for self-holding, a slight application of direct external force to the string or limbs in a forward direction or a slight rearward draw and release of the bowstring to more indirectly create forward force can overcome the bias of counteractive force and precipitate a movement into the more forward position of lower brace with a resultant release of potential energy by the bow.

The self-holding effect of the cock brace position occurs when the bow is braced at a height above the point affording the development of a counter bend or curve in the limbs, but to be selectively releaseable, it should be achieved just above this point and with a virtually imperceptible development of curve.

The undesirable earlier development of a curve in the limbs during the bending of the bow that substantially straightens their recurve does not prevent the achievement of a self-holding position. This position of higher brace is possible over the position of lower brace when a recurved bow with free string characteristics is braced by a bowstring of sufficiently reduced length. However, an initial inclusion or premature development of curve and the consequent presence of a substantial extent of curve at the point of a self-holding brace does tend to prevent a decisive, cooperative release to the lower brace position. For instance, one limb might release without precipitating the substantially simultaneous release of the other limb. The flexible limb sections are exclusively recurved when the bow is strung and do not develop a curve in the bending of the bow below the cock brace position in order to provide a decisive release therefrom to the position of lower brace with functionally simultaneous and cooperative limb action.

The bowstring requires that its length be substantially specific when connecting a particular set of limbs in a particular manner, to be coordinated with and determined by the combining physical characteristics of the limbs such as composition, especially in laminated constructions, taper and the included angle that is set by the substantially rigid handle section in addition to the contour of the limb recurvature.

A bow, made in accordance with this invention, to provide such a self-holding or cock brace position at a safe but readily releaseable brace level of stability offers many of the advantages of a cross bow without its complexity.

In the employment of the direct or free principle of stringing, modifications to normal bow structure should be made to move the cock position of the straight string rearward to a position a few inches short of a full draw so that the bow may be considered substantially predrawn and so that a full and practical use of the system may include a simple completion of the normal draw of 28 inches with comparatively little effort and greatly reduced finger pinch effect followed by a conventional release as a means of triggering the limb travel to the more forward position of lower brace. The limbs at cock brace with a straight string constrainment, should be very near the position of bend expected of a more normally achieved full draw with an angularly displaced string. If the cock brace, straight string position is considerably short of a full draw with this degree of bend, completion of the draw may be overly difficult and require over drawing of the limbs.

Since the bow is pre-drawn or brought to cock position before nocking of the arrow, forward brace height need not be made sufficient to clear fletching, and string travel may be accordingly increased. Much more importantly, as in the crossbow, the archer is free to use his feet and both hands if necessary in the cocking of especially heavy draw weights.

The herein described direct or free string condition may be variously achieved, but in the preferred embodiment, the bow limbs are centrally and lonitudinally slotted or divided from the rigid handle to nock or from handle through common riser to nock in the direction of limb and string travel to permit relatively free passage of the string through the limb or through riser and limb structure.

The preferred embodiment also should include a conventional direction of string attachment, i.e., the bow string loops about the back side of the nock and extends from the belly side of the bow. Stringing of the cock-bow, with conventionally attached bowstring, may be best accomplished in the cock brace position by means of a conventional bow stringer, ie., a temporary form of longer bowstring featuring pocket shaped end pieces for securing the limb tips, which permits the use of the feet in drawing the bow for string attachment, as in commonly known.

A reversed direction of bowstring attachment may also be employed, in which the self-holding effect, in a given bow, is achieved with a slightly shorter bowstring. In this case, the recurve is increased in the lower brace and the lower brace is thus made still lower. An advantage of the reversed bowstring connection is that the bow may be easily strung with its limbs in the forward or lower brace position. The bow is more simply bent to accomplish stringing by placing one limb tip on a ground support, grasping the other tip and applying body weight to bring the tips sufficiently close together, in the reflex direction, to nock the free end of the bowstring. A disadvantage of the reversed bowstring connection is that the initial weight may be made excessively heavy relative to the total power of the bow.

In the preferred embodiment, both modes of string attachment slightly modify a pure free string principle by virtue of bowstring contact with the brief span of surface that exists at the nocking section between the nock and the dividing slot made in the limb for string passage. In the conventional attachment this contact is made on the rearward or belly side in brace positions and in the reverse attachment such contact is made on the forward or back side, during the drawing of the bow.

While an adequate self-holding stability and generally acceptable sensitivity of release may be maintained by a properly fixed bowstring length, some method of minor adjustment is of value in allowing for personal preference, a slight stretching that may occur even with modern synthetic fibers, or severe thermal effects. With a temporary detachment of one end, as previously mentioned, a simple twisting or untwisting of the bowstring may be used to adjust its length in small increments. It is generally acceptable and convenient and does not add structure to the bow.

An early experimental bow was made in accordance with this invention from a Bear "76er" Custom #2158 with altered handle angle and riser extensions, such bow having a take-down design and being of low power with less than a normally desired cock-brace height, but suitable for demonstration of the working principles. The following physical parameters of such experimental bow were noted:

UNBRACED BOW

Working length, measured between centers of the limb nocking notches: 66⅝ inches. Rigid handle, between terminations: 29⅝ inches.

Working length of flexible limb sections, from rigid handle terminations in a straight line to center of limb nocking notch: 18½ inches.

Working length of flexible limb along outside of recurve surface: 19 9/10 inches.

The limbs were tapered in thickness from 5/16 inch to 3/16 inch at tip and in width from 1 7/16 inches to ⅞ inch at tip. The slot width was substantially uniform: 3/16 inch. The limb material was made of a solid fiberglass composition and the nocking sections at the tips were covered with a plastic overlay cap.

BRACED BOW with string adjustable by twisting near 66½ inches as measured with collapsed loops With shorter adjustment for greater stability and less sensitivity-working length of bow in low brace between limb nocking notches: 64½ inches With shorter adjustment for greater stability and less sensitivity-working length of bow in high brace between limb nocking notches: 65½ inches With longer adjustment for greater sensitivity—working length of bow in low brace between limb nocking notches: 64¾ inches With longer adjustment for greater sensitivity—working length of bow in high brace between limb nocking notches: 65¾ inches There is 1 inch of surface contact between center of nocking notches at the beginning of the upper end of the limb slot which alters in angle and accounts for the difference between nocking notch center measurements at low and high brace.

With shorter string adjustment—

Low brace height: 3⅝ inches Cock brace height: 11 11/16 inches

With longer string adjustment—

Low brace height: 4 inches Cock brace height: 11 inches

While the invention has been described with respect to certain specific embodiments, it will be appreciated that many modifications and changes may be made by those skilled in the art without departing from the spirit of the invention. It is intended therefore, by the appended cliams to cover all such modifications and changes as fall within the true spirit and scope of the invention.

What is claimed as new and what it is desired to secure by Letters Patent of the United States is:

1. In a bow including a substantially rigid handle section and a pair of elongated resiliently flexible limbs having nocks adjacent the respective free ends thereof, the improvement wherein said limbs are solely recurved in the unstrung condition of said bow and in the strung condition of said bow in a low position of brace, said bow further comprising a bowstring having a length determined by the distance between said limb nocks when said limbs are drawn to a position in which a small amount of curve is produced in each limb, said bowstring being drawable to move said limbs from said low position of brace to a high position of brace in which said bow is maintained in a self-holding cock position without the assistance of any external force, said bowstring and said limbs in said self-holding cock position of said bow being selectively releasable by a separate force applied by a user on said bowstring or bow to trigger movement of said bowstring and said limbs to said position of low brace.

2. In the bow as defined in claim 1 in which each said limb includes means for substantially avoiding contact with the connective span of said bowstring between said limb nocks.

3. In the bow as defined in claim 2 in which each said latter means includes a spaced longitudinal division of each limb through which said connective span of said bowstring extends.

4. In the bow as defined in claim 3 in which each said spaced longitudinal division in respective said limb extends into said rigid handle section.

5. In the bow as defined in claim 2 wherein each said latter means includes an elongated slot extending substantially throughout its length and terminating adjacent its said limb nocks.

6. In the bow as defined in claim 5 wherin each said slot extends into said rigid handle section terminating short of the hand engageable portion thereof.

7. In the bow as defined in claim 1 in which said bowstring includes means for substantially avoiding contact of its connective span between said limb nocks with each of said limbs.

8. In the bow as defined in claim 7 in which said latter means includes a pair of longitudinal divisions of its connective span spaced to pass on either side of respective said limbs during the normal travel of said bowstring.

9. In the bow as defined in claim 8 in which said bowstring includes spaced nock connecting loops at each and in which the division of said bowstring comprises a substantial enlargement of said connective loops to permit passage of said limbs therethrough during the normal travel of said limbs.

10. In the bow as defined in claim 9 wherein each of said limb nocks includes a pair of spaced nocking points for engagement by its said bowstring loop, said bowstring further comprising an arrow nocking section between said loops, said latter means further including a pair of spacer elements connected to respective said loops, adjacent said arrow nocking section.

11. In the bow as defined in claim 1 wherein said limbs are of substantially matching operating characteristics.

12. In the bow as defined in claim 11 wherein said limbs are substantially equal in length.

13. In the bow as defined in claim 1 wherein said rigid handle section includes opposite elongated portions inclined toward each other and having an included angle of less than 180°.

14. In the bow as defined in claim 1 in which said position of higher brace has a brace height slightly less than the length of a full draw of said bow.

15. In the bow as defined in claim 1 in which the draw weight is generally greater than weights commonly acceptable as being drawable in hand held bows.

16. In the bow as defined in claim 15 in which said handle section provides foot access for foot assistance in pre-drawing said bow to said cock position of higher brace.

17. In the bow as defined in claim 16 in which said handle section includes a foot access member projecting generally forwardly of said bow.

18. In the bow as defined in claim 17 further comprising an arrow rest, said foot access member being positioned adjacently below said arrow rest.

19. A bow having a rigid central handle portion joining two resiliently flexible limbs, each said limb when unstressed extending from said handle portion in a rearwardly inclined direction for a respective first length portion adjacent said handle portion and curving from such direction into a forwardly inclined resiliently bendable end portion terminating in a limb nock, a section of each limb between its end portion and said handle being resilient and recurved, a bowstring connected between said nocks of said limbs having a length equal to the distance between said limb nocks when drawn to a position in which a portion in each of said sections is substantially straightened whereby said bow is maintained in a self-holding cock position of high brace without the assistance of any external force, said limbs being selectively releasable by a separate force supplied by a user on said bowstring or bow to trigger movement of said bowstring and limbs to a position of low brace.

20. The bow as defined in claim 19 wherein said limbs are of substantially matching operating characteristics.

21. The bow as defined in claim 20 wherein each of said limbs is bifurcated adjacently below said limb nocks to substantially freely pass said bowstring therethrough during its normal path of travel between said positions of low and high brace.

22. The bow as defined in claim 21 wherein said handle portion is bifurcated adjacent each said limb to substantially freely pass said bowstring therethrough into its position of low brace.

23. In a bow including a substantially rigid handle section and a pair of elongated resiliently flexible limbs having nocks adjacent the respective free ends thereof, the improvement wherein said limbs are solely recurved in the unstrung condition of said bow and in the strung condition of said bow in a low position of brace, a bowstring means having a length determined by the distance between said limb nocks when said limbs are drawn to a position in which a small amount of curve is produced in each limb, said bowstring means when attached to said bow being drawable to move said limbs from said low position of brace to a high position of brace in which said bow may be maintained in a self-holding cock position by said small amount of curve in each said limb, said bowstring means and said limbs in said self-holding cock position of said bow being selectively releasable to permit movement of said bowstring means and said limbs to said position of low brace, said bowstring means being adjustable in length to slightly exceed the length thereof required for obtaining said self-holding cock position so that self-holding cocking position is not achieved, thus requiring a minimal holding force on said bowstring means to maintain said bow in a drawn position adjacent the self-holding cock position, said self-holding cock position being maintained by only the characteristics of said bow and said bowstring means.

24. A cockable bow having a position of low brace and a cocked position of high brace and no auxiliary device to maintain and release its bowstring and limbs in and from a position of high brace consisting essentially of a pair of resiliently flexible limbs respectively connected to the ends of a substantially rigid handle, and a bowstring attached between nocks of said limbs and of a predetermined length said limbs being self-holding in a position of high brace of said bow without any assistance of a user and being releaseable therefrom by a separate force applied to said bowstring or said bow by a user.

25. The bow as defined in claim 24 wherein said limbs are recurved.

* * * * *